United States Patent [19]

Anthony et al.

[11] Patent Number: 5,038,446

[45] Date of Patent: Aug. 13, 1991

[54] BELT BUCKLE WITH INTERLOCKING DUAL TONGUE

[75] Inventors: James R. Anthony, Carmel; Michael A. Wiseman, Indianapolis; Allan R. Lortz, Carmel, all of Ind.

[73] Assignee: Indiana Mills & Manufacturing, Inc., Westfield, Ind.

[21] Appl. No.: 536,170

[22] Filed: Jun. 11, 1990

Related U.S. Application Data

[63] Continuation-in-part of Ser. No. 370,240, Jun. 22, 1989.

[51] Int. Cl.[5] ..... A44B 11/00

[52] U.S. Cl. ..... 24/573.5; 24/632; 24/642

[58] Field of Search ..... 24/573.5, 632, 642, 24/656, 541, 639, 652, 199, 200, 573.2; 297/481

[56] References Cited

U.S. PATENT DOCUMENTS

| | | | |
|---|---|---|---|
| 2,461,785 | 2/1949 | Sullivan | 24/573.5 |
| 3,491,414 | 1/1970 | Stoffel | 24/632 |
| 3,523,342 | 8/1970 | Spires | 24/632 |
| 3,534,448 | 10/1970 | Hughes | 24/573.5 |
| 3,605,210 | 9/1971 | Lohr | 24/642 |
| 4,128,924 | 12/1978 | Happel et al. | 24/642 |
| 4,196,500 | 4/1980 | Happel et al. | 24/632 |
| 4,228,567 | 10/1980 | Ikesue et al. | 24/642 |
| 4,374,449 | 2/1983 | Stephenson et al. | 24/656 |
| 4,382,320 | 5/1983 | Yamamura . | |
| 4,425,688 | 1/1984 | Anthony et al. | 24/656 |
| 4,610,058 | 9/1986 | Stemmildt et al. | 24/573.5 |
| 4,617,705 | 10/1986 | Anthony et al. | 24/642 |
| 4,678,928 | 7/1987 | Nishimura et al. . | |
| 4,809,410 | 3/1989 | Van Riesen | 24/573.5 |

FOREIGN PATENT DOCUMENTS

| | | | |
|---|---|---|---|
| 2828049 | 1/1980 | Fed. Rep. of Germany . | |
| 3404508 | 8/1984 | Fed. Rep. of Germany . | |
| 1328405 | 4/1963 | France | 24/656 |
| 2464666 | 3/1981 | France . | |
| 0822857 | 11/1959 | United Kingdom | 24/632 |

*Primary Examiner*—Victor N. Sakran
*Attorney, Agent, or Firm*—Woodward, Emhardt, Naughton, Moriarty & McNett

[57] ABSTRACT

A seat belt buckle with a pair of buckle tongues. The buckle includes a spring mechanism slidably movable within the buckle housing from a position blocking engagement of a latch when a single tongue is inserted to a position away from the latch when both tongues are inserted allowing the latch to engage the tongues. In one embodiment, a latch indicator is slidably mounted to the buckle push button in the buckle cover and includes a lower end contacting the latch. The indicator is movable from a position flush with the buckle push button when the latch is not engaged with the tongues to an upraised position over the button when the latch moves up and engages the tongues. The tongues have mating portions, but are separable.

11 Claims, 5 Drawing Sheets

BELT BUCKLE WITH INTERLOCKING DUAL TONGUE

REFERENCE TO RELATED APPLICATIONS

This Application is a continuation-in-part of co-pending/prior-filed U.S. patent application Ser. No. 370,240 filed June 22, 1989.

BACKGROUND OF THE INVENTION

A seat belt buckle devised to maximize holding capability as well as to improve the cost and ease of manufacture is disclosed in the U.S. Pat. No. 4,617,705 issued to James R. Anthony and Allan R. Lortz. The buckle includes a reinforcement plate mounted to and between an upper and lower housing containing a spring biased pawl engageable with a seat belt tongue. The pawl is held captive between the lower housing and the reinforcement plate, and is biased upwardly against the plate by a pair of springs. A push button is slidably mounted to the upper housing and has a pair of legs extending downwardly through the plate to contact and move the pawl downwardly to disengage the pawl from the tongue. An additional spring mounted between the push button and reinforcement plate requires force above a predetermined level to move the button downwardly and to disengage the pawl from the tongue. In many cases, the seat belt tongue is split into two separate tongues for attachment respectively to a seat belt and a shoulder harness. It is desirable to provide such a belt buckle having a pair of tongues interlockable together, but easily separable to facilitate disengagement of the belt and harness with the user.

False latching between a belt buckle and associated tongue must be avoided. In the case of a belt buckle engageable with a pair of tongues, the buckle must be designed so that it will not lockingly engage when only a single tongue is inserted into the buckle. We have therefore devised a belt buckle which will lockingly engage the tongues only when both tongues are fully inserted therein.

When utilizing a pair of tongues in combination with a buckle, it is easy to insert one or more of the tongues in an incorrect manner. For example, a tongue could be inserted upside down thereby causing twists in the seat belt or shoulder harness. We have therefore designed the interface between the tongues and buckle to allow insertion of the tongues only in the correct manner.

SUMMARY OF THE INVENTION

One embodiment of the present invention is a belt buckle-tongue combination comprising a buckle main body, a tongue insertable into and releasable lockable with the buckle main body, a latch positioned in the main body and held captive therein, the latch movable between a latched position with the tongue and an unlatched position, the latch including a guide pin attached thereto and oriented so that the axis of the pin aligns with the direction of motion of the latch when the latch moves between the latched and the unlatched position, a first device operably associated with the latch to move the latch back and forth between the latched position and the unlatched position, and a bushing mounted within the main body for defining an axis of movement for the guide pin, the bushing receiving the guide pin therein to confine movement of the latch along a single axis.

Another embodiment of the present invention is a belt buckle-tongue combination comprising a buckle tongue of elongate shape, a buckle main body having a cavity therein to slidably receive the tongue, a movable latch including a guide pin attached thereto the latch mounted in the body for engaging the tongue inserted in the body, a manual operator device accessible at the exterior of the body and engaged with the latch being movable to move the latch relative to the tongue, a first spring being operable to normally apply force against the movable latch to move same into engagement with the tongue when inserted into the body in a first condition but yieldable to allow movement of the movable latch away from the tongue, and false latch device movably mounted in the body and contactable and moved by the tongue when inserted into the body, the false latch device being operable to allow the latch to lockingly engage the tongue when the tongue is in a first condition and inserted into the body and further operable to hold the latch from locking engagement with the tongue when the tongue is in a second condition.

A further embodiment of the present invention is a pair of tongues lockingly engageably with a belt buckle comprising, a first tongue including a first main body with an elongated first member extending therefrom in a first direction and insertable into a buckle and further including an aperture through which a first web is mountable, the first main body including a U-shaped channel, and a second tongue including a second main body with an elongated second member extending therefrom in the first direction and insertable into the buckle and further including a second aperture through which a second web may be mounted, the second main body including a U-shaped surface sized to removably and slidably engage the U-shaped channel of the first tongue thereby positioning the elongated first member adjacent to and in the same plane as the elongated second member so each tongue is independently insertable into the belt buckle.

It is an object of the present invention to provide a new and improved seat belt buckle.

A further object of the present invention is to provide a seat belt buckle operable with a pair of tongues, but which will lockingly engage the tongues only when both are inserted therein.

Likewise, it is an object of the present invention to provide a pair of seat belt buckle tongues lockingly engageable together, but easily separable apart.

An additional object of the present invention is to provide means on a seat belt buckle and associated tongues preventing the tongues from being inserted in an erroneous manner.

Related objects and advantages of the present invention will be apparent from the following description.

BRIEF DESCRIPTION OF THE DRAWINGS

FIG. 1 is a top view of the tongue of FIG. 9 showing the tongue separated into a pair of tongues.

DESCRIPTION OF THE PREFERRED EMBODIMENTS

Figure 1:
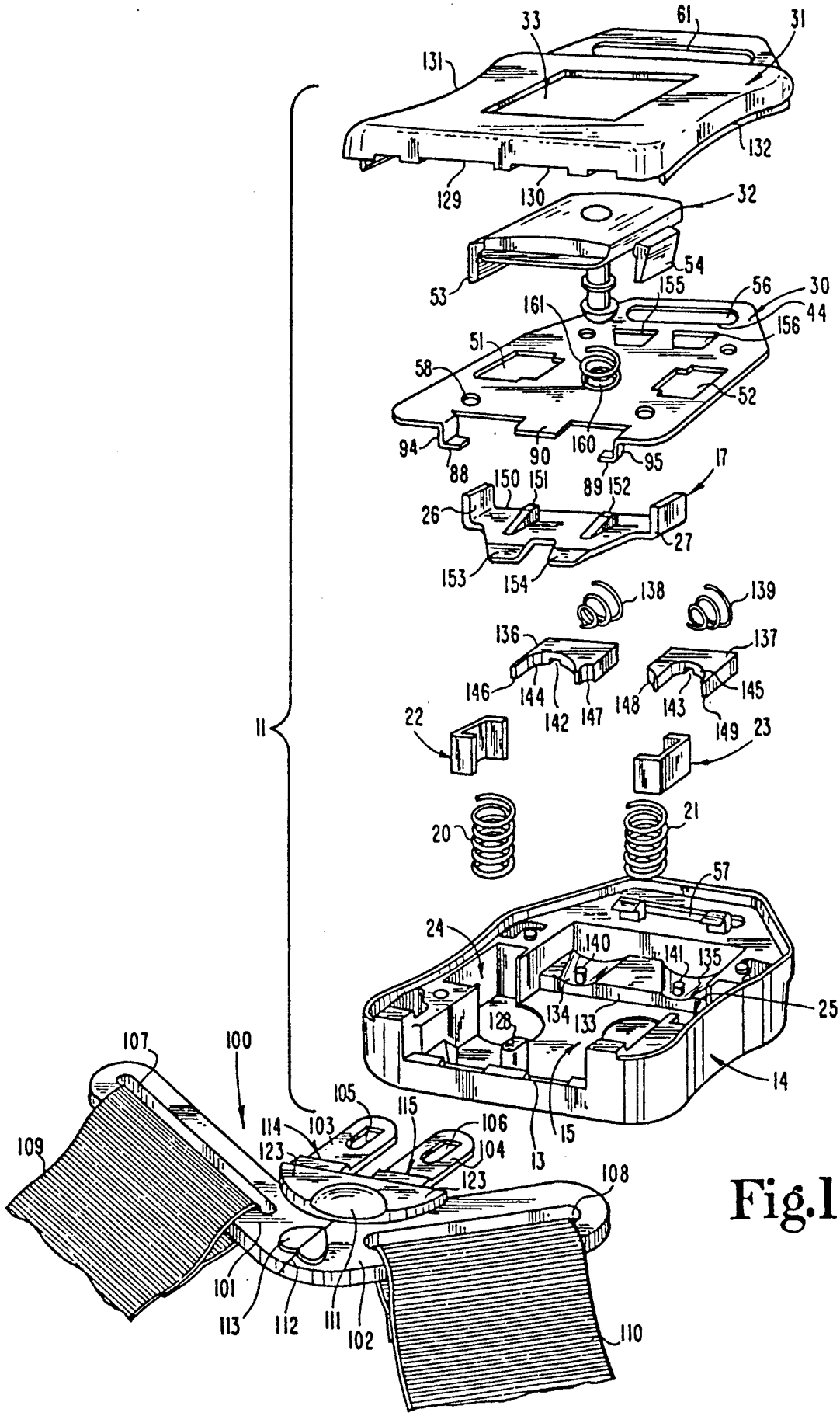
FIG. 1 is an exploded, perspective view of the buckle and tongue combination of an alternate embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a buckle tongue combination consisting of a buckle 11 shown in exploded view and a buckle tongue 100 consisting of a pair of interlocking, but separable, buckle tongues 101 and 102. Buckle 11 includes a main body 14 having a mouth 13 for receiving the leading edge of tongue 100 which extends into a cavity 15 formed in main body 14. Tongues 101 and 102 include apertures 105 and 106 through which two upraised portions 151 and 152 of pawl or latch 17 project. Tongues 101 and 102 include second apertures 107 and 108 with webs 109 and 110 extending therethrough. The two webs may represent a seat belt and harness shoulder web. A pair of helical springs 20 and 21 rest within cavity 15 and urge latch 17 to the upward position whereat the latch is locked to tongue 100. A pair of channels 22 and 23 are secured within complimentarily sized cavities 24 and 25 opening into main cavity 15. Channels 22 and 23 slidably receive the mutually opposed and upturned arms 26 and 27 of latch 17. The forward edge of latch 17 is split into a pair of legs 153 and 154 having an upper surface beveled downwardly to guide tongues 101 and 102 toward the upraised portions 151 and 152 of the latch which are extendable through apertures 105 and 106. Springs 20 and 21 are positioned between the bottom wall of main body 14 forming cavity 15 and the undersurface of latch 17. A reinforcement plate 30 is attached to main body 14 and in turn is attached to cover 31 with a push button 32 located between cover 31 and plate 30 and projectable partially through aperture 33 of cover 31 to allow the operator to depress the button thereby depressing latch 17 to the downward or unlocked position. Button 32 includes lateral extensions positioned beneath cover 31 preventing the button from escaping the buckle described in U.S. Pat. No. 4,617,705 herewith incorporated by reference. Button 32 also includes legs 53 and 54 which contact the upper surface of the latch immediately inward, respectively, of arms 26 and 27 once the button is pushed sufficiently downward to unlatch the tongues. Helical spring 161 is positioned between button 32 and plate 30 surrounding sleeve 160 and is operable to force the button upwardly, but yieldable to allow the button to be depressed thereby releasing the latch from the tongues. Spring 161 increases the positive force required to depress button 32.

Main body 14 and cover 31 may be made from a material such as plastic and have side recess 131 and 132 formed therein. The pair of helical springs 20 and 21 rest on the upwardly facing surface of the bottom wall of main body 14 and contact the bottom surface of latch 17. Optional pins may be used to secure the main body 14 to cover 31 and extend upwardly through plate 30. A circumferentially extending channel may be formed in the upper edge portion of main body 14 to receive the edge of reinforcement plate 30 and a downwardly extending lip of cover 31 with the lip extending in a force fit relationship between the edge of reinforcement plate 30 and the top edge of cover 14, all as shown and described in U.S. Pat. No. 4,617,705.

Figure 7:
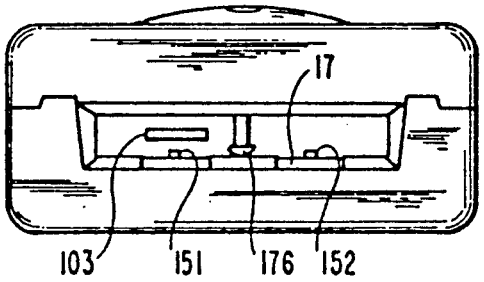
FIG. 7 is an end view of the buckle of FIG. 1 showing a single tongue inserted therein.
Figure 8:
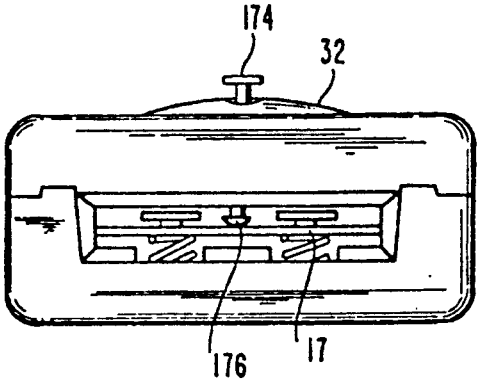
FIG. 8 is the same view as FIG. 7 only showing a pair of tongues inserted into the buckle.

Plate 30 has a forward edge with a pair of downwardly extending legs 94 and 95 in turn having, respectively, inwardly extending portions 88 and 89. Legs 94 and 95 are perpendicularly arranged to the plate and the distal ends which are parallel to the plate. The legs contact the upwardly facing surface of the bottom wall of housing 14 and support the plate thereatop. The legs are formed from the leading edge of the plate leaving a center portion 90 positioned therebetween which contacts an upwardly extending boss 128 integrally formed with the bottom housing 14. Boss 128 extends upwardly to a downwardly extending projection of cover 31 dividing the mouth into a pair of mouths to receive the forwardly extending portions 103 and 104 of tongues 101 and 102. Boss 128 has not been shown in FIGS. 7 and 8 to enable a better depiction of the indicator bottom end.

Plate 30 includes a pair of apertures 51 and 52 aligned with cavities 24 and 25 to receive the downwardly extending button legs 53 and 54 which project through the plate and movable against the top surface of the latch. A third aperture 56 is formed rearwardly of edge 44 and is aligned with aperture 57 of main body 14 and a similarly located aperture 61 of cover 31 to allow a seat belt to be attached to the buckle. A plurality of apertures 58 are located around the peripheral portion of plate 30 to receive the pins which extend through the plate and into the main body 14 and cover 13 to provide additional strengthening means securing the cover plate and main body together.

Figure 6:
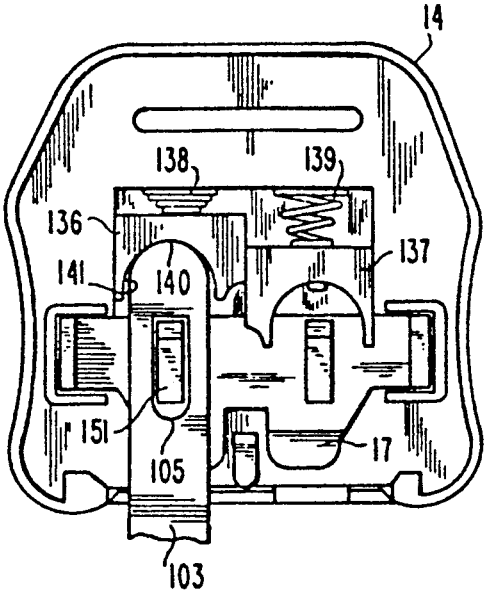
FIG. 6 is the same view as FIG. 5 only showing a single tongue inserted into the buckle.

A pair of concave cavities 134 and 135 are formed in the aft portion of cavity 15 being separated by an upraised portion 133 to receive a pair of horizontally extending wire springs 138 and 139. Both cavities 134 and 135 are tapered so that the smaller end of the cavities face forward to receive the complementary shaped tapered ends of wire springs 138 and 139. To insure the buckle will latch only when both tongues are inserted therein, a pair of plastic anti-false latching members 136 and 137 are provided within cavity 15 being located between the rear edge 150 of latch 17 and the forward ends of springs 138 and 139. Members 136 and 137 have forwardly opening concave surfaces 144 and 145 to respectively engage the rounded distal ends of tongue bars 103 and 104. Each member 136 and 137 has a downwardly opening cavity 142 and 143 to receive, respectively, pins 140 and 141 which project upwardly from the bottom of cavity 15 thereby mountingly holding members 136 and 137 within the cavity. Each cavity 142 and 143 opens through, respectively, surfaces 144 and 145 to allow members 136 and 137 to slide horizontally backward compressing springs 138 and 139 when the tongues are fully inserted thereby contacting the surfaces 144 and 145. Likewise, when the tongue bars are withdrawn from the buckle, springs 138 and 139 force members 136 and 137 horizontally in the direction of the mouth of the buckle. Members 136 and 137 each have an outwardly located side extension 146 and 149 and center extensions 147 and 148 which normally project above the upper surface of latch 17 when tongue bars 103 and 104 are not inserted into the buckle. In the event a single tongue bar is inserted into the buckle, only a single member 136 or 137 moves rearwardly thereby allowing the remaining unmoved member to project over the latch and prevent the latch from engaging the inserted tongue bar. For example, in the event tongue bar 103 is inserted into cavity 15 while tongue bar 104 remains outwardly of the buckle, the rounded distal end 140 (FIG. 6) of tongue bar 103 will engage the downwardly beveled leg 153 of the latch eventually positioning aperture 105 immediately over projection 151. Simultaneously, tongue bar 103 will engage concave surface 144 and move member 136 rearwardly thereby moving projections 146 and 147 away from latch 17. Projections 148 and 149 of member 137, however, will remain above latch 17 preventing the latch from moving upwardly by the force of helical springs 20 and 21 and thereby preventing upraised latch portion 151 from entering opening 105. The upper edge 141 (FIG. 6) of concave surface 146 is located above the top surface of tongue bar 103.

Figure 4:
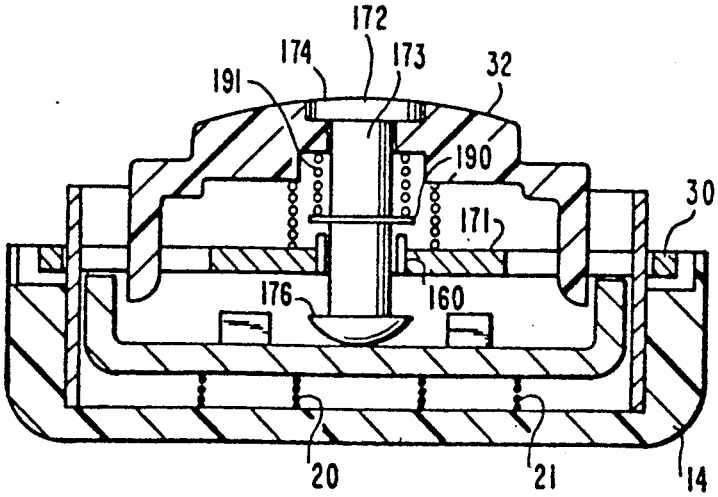
FIG. 4 is a cross-sectional view of the buckle of FIG. 1 with the upper housing removed therefrom.
Figure 5:
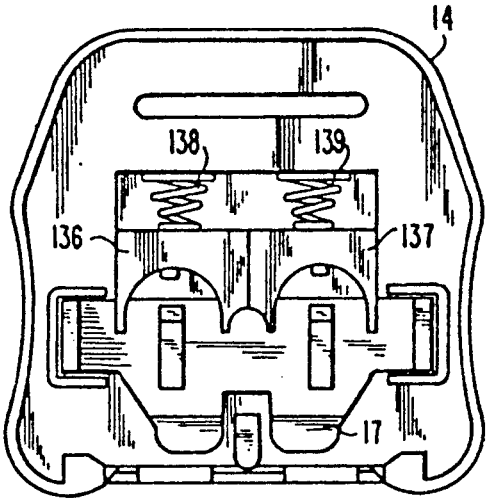
FIG. 5 is a top view of the buckle of FIG. 1 only with the reinforcement plate and portions thereabove removed to illustrate the position of the pawl.

The buckle push button is provided with an indicator for clearly illustrating when the buckle is lockingly engaged with both tongues. The central portion of button 32 (FIG. 4) is provided with a counter bored hole to receive indicator 172. The stem 173 of the indicator extends freely through button 32 and has a head 174 integrally formed thereon which is complimentarily received in the counter bore recess of the button aperture. The upper surface of head 174 is smoothly contoured to blend into the convex upwardly facing surface of button 32 when the button is in the retracted position corresponding to indicating the buckle is not lockingly engaged with both tongues. Stem 173 extends through a upwardly projecting sleeve 160 (FIG. 1) fixedly mounted to the center portion of upwardly facing surface 171 of reinforcement plate 30. Stem 173 projects through sleeve 160 and the reinforcement plate towards latch 17. An enlarged rounded bottom end 176 is mounted to stem 173. A projection, such as a washer 190 is fixedly mounted to stem 173 supporting a helical spring 191 thereatop which has a top end engaging the bottom surface of button 32. Spring 191 is operable to urge button head 174 downwardly into the button counter bored recess, but is yieldable to allow the head 174 to extend above the button 32 once latch 17 moves upwardly to the latched condition thereby forcing bottom end 176 of the indicator upwardly. End 176 is larger than the inside diameter of sleeve 160 to prevent the indicator from escaping the buckle and may be affixed to stem 173 once the stem is inserted through sleeve 160. Center projections 147 and 148 (FIG. 1) have distal concave shaped ends forming a partial semicircular cavity to prevent any interference with bottom end 176 of the indicator. A pair of apertures 155 and 156 (FIG. 1) are provided to prevent interference between the plate, helical springs 138 and 139 and upraised latch portions 151 and 152.

When the tongue bars 103 and 104 are not inserted into the buckle, the top surface of indicator head 174 is flush with the upwardly facing surface of button 32. Once both tongue bars 103 and 104 are inserted into the buckle and are lockingly engaged with upraised latch portions 151 and 152, latch 17 moves to the upward position (FIG. 8) compressing spring 191 and moving stem 173 upward until head 174 projects above the upwardly facing surface of button 32. An indication is therefore provided that the buckle is lockingly engaged with the buckle tongues. To disengage the buckle with the tongues, buckle 32 is moved downwardly thereby forcing latch 17 downwardly disengaging the upraised latch portions with the tongue bars.

Buckle tongue 100 consists of two interlockable, but separable tongues 101 and 102 each having fixedly mounted thereto in cantilevered fashion tongue bars 103 and 104. Tongue bars have respectively D-shaped apertures 105 and 106 with the flat portion of the D-shaped hole being located adjacent the rounded distal ends of the tongue bar to engage the upraised latch portions 151 and 152. Tongue bars 103 and 104 are provided with upraised portions 114 and 115 adjacent their proximal ends with the upraised portions 114 and 115 being complimentarily shaped to fit into, respectively, recesses 129 and 130 formed in the top cover 31. Thus, if the tongue bars 103 and 104 are turned upside down, then upraised portions 114 and 115 will not fit into recesses 129 and 130, and instead will contact the outwardly facing surface of housing 14 adjacent the buckle mouth preventing full insertion of the tongue bars and thereby preventing engagement of recesses 105 and 106 with upraised latch portions 151 and 152.

Tongues 101 and 102 (FIGS. 2 and 3) have overlapping walls 117 and 116, respectively, which extend over and adjacent the other tongue. For example, tongue 101 includes wall 117 which extends outwardly of and adjacent tongue 102, whereas wall 116 integrally attached to tongue 102 extends outwardly and adjacent tongue 101. Walls 116 and 117 are provided, respectively, with projections 118 and 119 which fit into complimentarily sized apertures provided in the outwardly facing surface of each tongue. For example, tongue 101 includes aperture 120 which releasably receives projection 118 of wall 116. Likewise, projection 119 which extends upwardly from surface 121 of wall 117 extends into an aperture provided in the downwardly facing surface of tongue 102 as viewed in FIG. 2.

Figure 2:
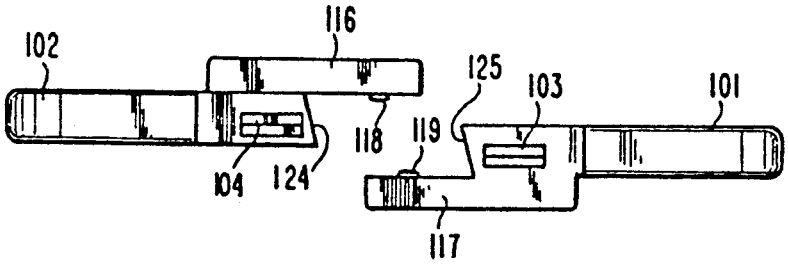
FIG. 2 is an end view of the tongue of FIG. 1 only showing the tongue separated into a pair of tongues.
Figure 3:
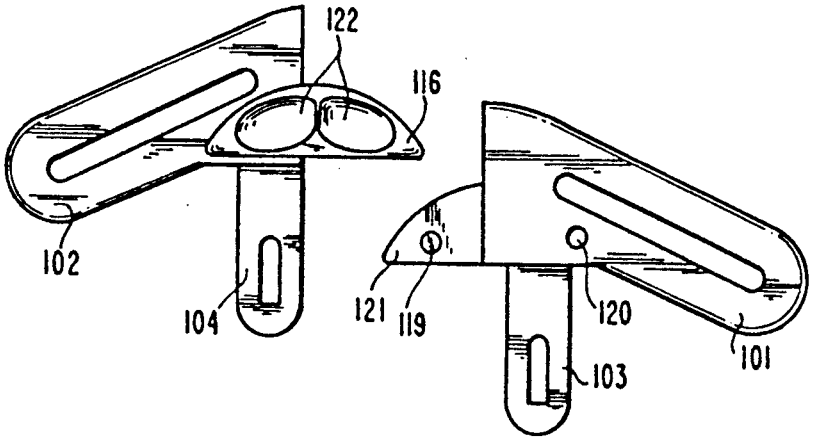
FIG. 3 is a top view of the tongues shown in FIG. 2 with the tongues being separated to fully illustrate the interlocking end portions.

The mutually facing surfaces 124 and 125 of tongues 102 and 101 are at an angle relative to the vertical axis as shown in FIG. 2 facilitating the sliding together of the tongues and the eventual extension of projections 118 and 119 into the adjacent apertures provided in the tongues.

Wall 116 integrally attached to tongue 102 has a downwardly facing surface with a pair of finger depressions 122. Likewise, wall 117 attached to tongue 101 has an upwardly facing surface 123 (FIG. 1) with a single thumb depression 111 formed therein enabling the user to grasp the pair of tongues by placing the user's thumb in depression 111 and the second and third fingers of the hand in depressions 122. A heart-shaped upraised portion 113 is formed on the upper surface of tongues 101 and 102 to provide an indication of which side of the tongues should face upwardly. Upraised portion 113 is divided in half along the tongue mating line 112 which is aligned with mating surfaces 124 and 125 of the tongues.

Figure 9:
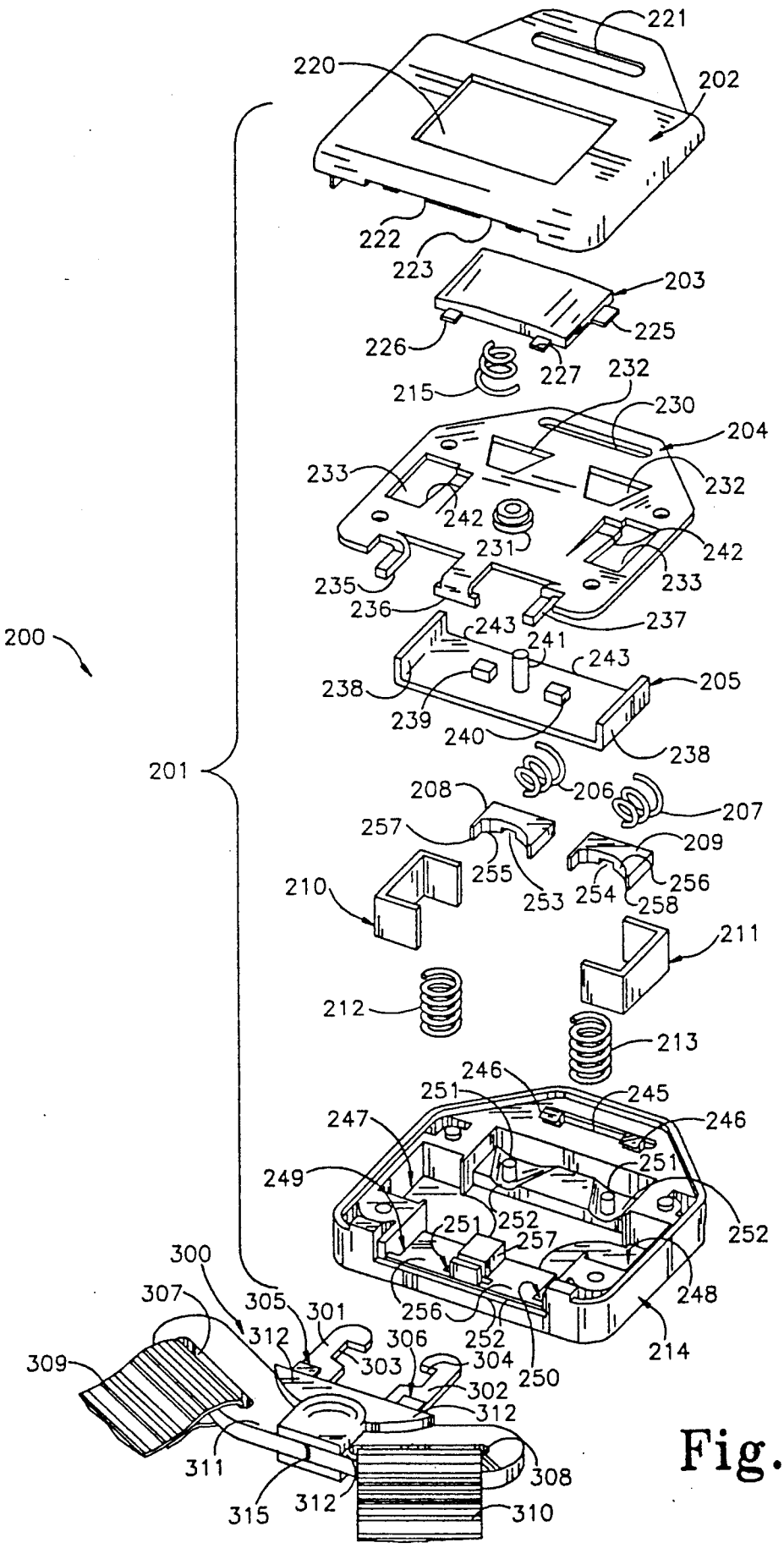
FIG. 9 is an exploded, perspective view of the buckle and tongue combination of the preferred embodiment of the present invention.
Figure 10:
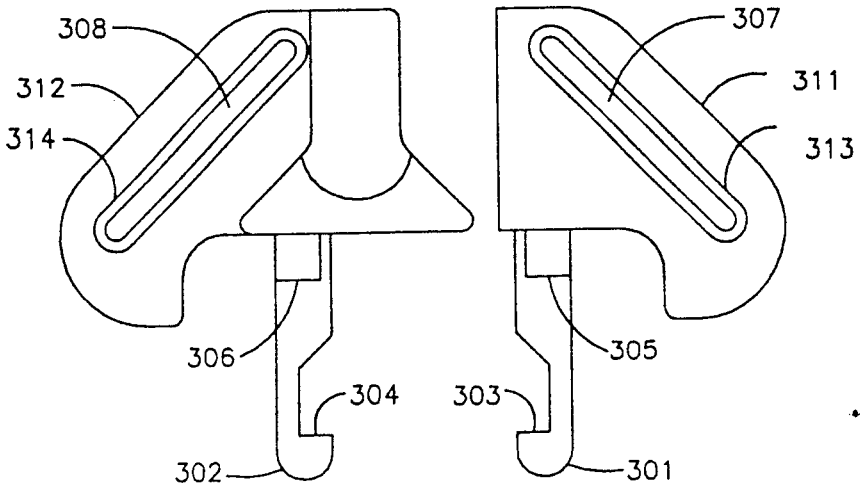

Referring now to FIG. 9, the preferred embodiment of the belt buckle with interlocking dual tongue 200 according to the present invention is shown. An exploded perspective view of the buckle 201 is shown in FIG. 9 detailing the component parts internal within buckle 201. The buckle 201 and dual tongue 300 include the anti-falsing latching function described in conjunction with the embodiment shown in FIGS. 1–8. The latching indicator of the previous embodiment is not included in the embodiment of FIGS. 9–12. However, an improved latching pawl having a guide pin attached thereto is included in the embodiment of FIGS. 9–12 to enhance the operation of and encourage smooth latching and unlatching of the buckle 201 and dual tongue 300.

Buckle 201 includes the following component parts: cover 202, push button 203, reinforcement plate 204, pawl or latch 205, anti-falsing latching members 208 and 209, channels 210 and 211, main body 214, and springs 215, 206, 207, 212 and 213.

Cover 202 includes an aperture 221 for receiving a web commonly used in a seat belt harness (not shown). Aperture 220 is shaped to receive push button 203 from the underside. Tabs 225 on the opposite sides and tabs 226 and 227 on the opposite ends of the push button contact the underside of cover 202 and retain push button 203 within aperture 220. Spring 215 is located over bushing 231 and upwardly biases push button 203 into aperture 220.

Reinforcement plate 204 includes aperture 230 which aligns with aperture 221 thereby allowing the web material to pass therethrough. Apertures 232 are designed to receive and retain springs 206 and 207 once springs 206 and 207 are positioned behind anti-falsing latching members 208 and 209, respectively, in channels 252 of main body 214. Apertures 233 are shaped to receive channels 210 and 211. Guide members 242, formed by shearing and bending portions of plate 204 provide lateral guides for tongue bars 301 and 302 when the bars are inserted into the buckle 201 along surfaces 256. Plate 204 includes locating tabs 235, 236 and 237 formed integrally with plate 204. Tabs 235, 236 and 237 are received in slots 249, 251 and 250, respectively, of main body 214 when plate 204 is positioned into main body 214.

Figure 12:
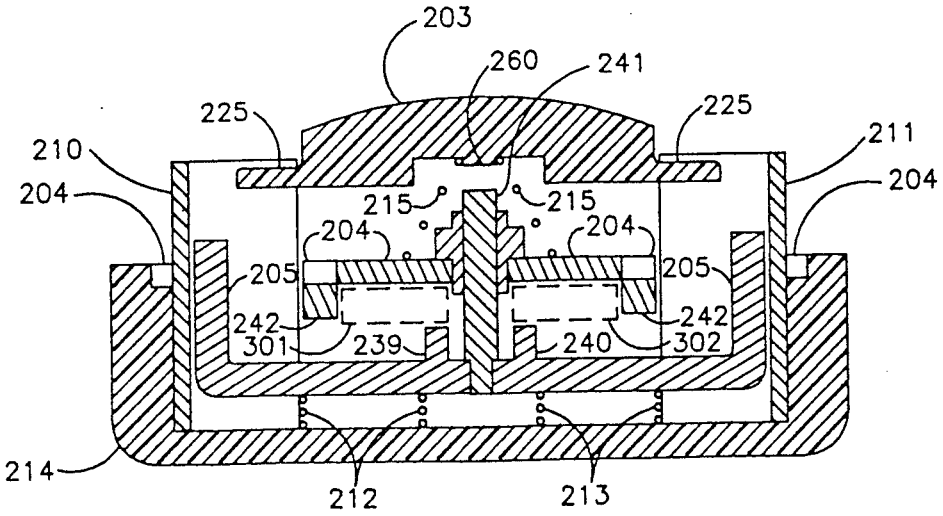
FIG. 12 is a cross-sectional view of the buckle of FIG. 9 with the cover removed and the buckle in the unlatched position and depicting the internal arrangement of the buckle with respect to the location of the inserted tongue bars.

Pawl 205 includes horizontal rising portions 238 sized to coincide with channels 210 and 211. Thus, pawl 205 can move vertically yet is restricted horizontally by channels 210 and 211. Locking tabs 239 and 240 coincide with and engage cutouts 303 and 304 of tongue bars 301 and 302, respectively, when pawl 205 is spring biased upwards by springs 212 and 213. In order for pawl 205 to move upwards within channels 210 and 211, anti-falsing latching members 208 and 209 must be horizontally moved by tongue bars 301 and 302 thereby allowing pawl 205 to move vertically. Members 208 and 209 are spring biased horizontally by springs 206 and 207, respectively. Pawl 205 is retained in an unlocked position as shown in FIG. 12 by members 208 and 209 which physically engage pawl 205 and prevent movement of pawl 205 in a vertical direction. Essentially, the anti-falsing mechanism of this embodiment of the present invention functions identically as the buckle shown in FIGS. 1–8. Pawl 205 also includes guide pin 241 which is press fitted into pawl 205. Pin 241 extends upwardly through bushing 231 so that push button 203 may contact pin 241 thereby moving pawl 205 downward to unlatch the buckle 201 and tongue 300. Guide pin 241 prevents pawl 205 from assuming a position which is askew from the plane of the plate 204. Thus, latching and unlatching of the individual tongue bars 301 and 302 occurs simultaneously as a result of the well defined linear movement of pawl 205 in the direction of the cylindrical axis of the guide pin 241 retained and guided by bushing 231.

Main body 214 includes cavities 247 and 248 for receiving channels 210 and 211, locating pins 251 and cavities 252 for receiving springs 206 and 207. Pins 251 coincide with apertures 253 and 254 to limit horizontal movement of members 208 and 209. The front or leading edge 257 and 258 of members 208 and 209, respectively, engages pawl 205 to prevent movement of pawl 205 when members 208 and 209 are spring biased toward the tongue 300 over the upper rear edge 243 of pawl 205 and pawl 205 is lowered as a result of operator depression of push button 203 into an unlatched position.

Clips 246, integrally molded with main body 214, provide a latching mechanism to hold plate 204 within main body 214. Clips 246 pass through aperture 230 of plate 204 and retain plate 204 in position.

When positioned in the main body 214, plate 204 provides a channel defined by tabs 235 and 237 in conjunction with surfaces 256 and 257 into which tongue bars 301 and 302 are inserted. Bevelled edge 252 assists in guiding tongue bars 301 and 302 into the appropriate apertures of buckle 201. Aperture 245 of main body 214 aligns with apertures 230 and 221 to allow webbing to pass therethrough.

Upon insertion into the belt buckle, the forward rounded distal ends of tongue bars 301 and 302 engage concave surfaces 255 and 256 of members 208 and 209, respectively, and move members 208 and 209 rearwardly into the main body 214. Once members 208 and 209 are moved by tongue bars 301 and 302 pawl 205 is released from the unlatched position thus enabling pawl 205 to move upwards as a result of forces from springs 212 and 213 within channels 210 and 211. Upon rising upwards, tabs 239 and 240 will engage cutouts 303 and 304, respectively, thereby retaining the dual tongue assembly 300 in the buckle 201. As with the previously described embodiment, unless both members 208 and 209 are simultaneously engaged by both tongue bars 301 and 302, the anti-falsing latching members retain pawl 205 in the unlatched position and springs 206 and 207 act to eject any inserted tongue bar.

Web 309 is received within aperture 307 of tongue portion 311. Web 310 is received in aperture 308 of tongue portion 312. Tongue 311 resides in a U-channel 315 formed or molded into in tongue 312. Tongue guides 305 and 306 mate with and are received in apertures 222 and 223 of cover 202 so that the dual tongue 300 cannot be inverted or rotated 180 degrees and inserted into the buckle 201.

Cover 202, push button 203, and main body 214 can be formed or manufactured using plastic materials. Reinforcement plate 204 is preferably made of steel or other metal suitable for providing strong reinforcing strength. Pawl 205 and locating pin 241 are made of steel or other suitable material. Bushing 231 is made of nylon. Channels 210 and 211 are made of metal. Anti-falsing latching members 208 and 209 may be made of plastic, nylon or other suitable material.

Dual tongue 300 includes two metallic portions 313 and 314 (FIG. 10) comprising the tongue bars 301 and 302, respectively. The metallic portion 313 and 314 provide reinforcement for the plastic molded over the metallic portions 302 and 314 of tongue 312. Reinforcement for tongue 311 is provided by the metal portion 313 which includes tongue bar 301. Cutouts 303 and 304 receive pins 239 and 240, respectively, of pawl 205 when the tongue 300 is inserted into the buckle 201 and the buckle latches onto the tongue and retains it therein until released by a depression of push button 203. Cutouts 303 and 304 are symmetrically opposed narrowed portions of tongue bars 301 and 302, respectively, wherein the tongue bars are approximately one half their broadest width. One edge of each cutout, 303 and 304, is formed along a line which is perpendicular to the direction of insertion of the tongue into the buckle, thereby providing a surface for pins 239 and 240 to act against for applying a retaining force to the tongue bars 301 and 302 when the buckle latches.

Figure 11:
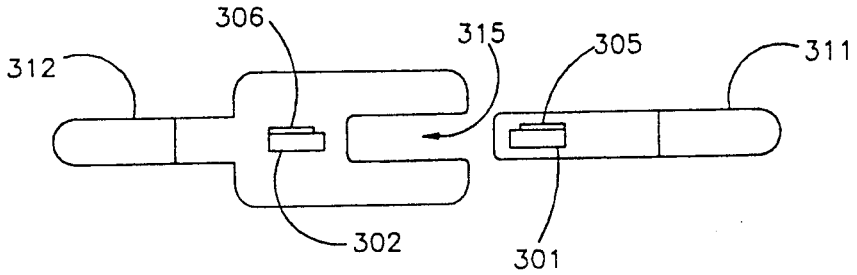
FIG. 11 is an end view of the tongues of FIG. 10 with the tongues separated to illustrate the configuration of the two tongues.

As shown in FIG. 11, tongue 311 is shaped to be laterally received into U-shaped channel 315 of tongue 312 thereby positioning tongue bars 301 and 302, respectively, in proper location so as to be received within the channels defined by surfaces 256, 257 and tabs 235 and 237. Also shown in FIG. 11 are guide members 306 and 305 which prevent inversion of the tongue when inserted into the buckle 201.

Referring now to FIG. 12, a cross-sectional view of buckle 201 is shown. Actuator tab 260 of push button 203 is shown. Tab 260 contacts pin 241 when the pawl 205 and pin 241 assembly are allowed to move upwardly (i.e. when the buckle "latches") when the anti-falsing latching members 208 and 209 (not shown in FIG. 12) are moved rearwardly by tongue bars 301 and 302. Plate 204, which includes guide members 242 formed integrally from plate 204, provides an additional guide for positioning tongue bars 301 and 302 properly within the cavity defined thereby. Upon moving vertically upwards, pawl 205 and latching pins 239 and 240 will engage the cutouts 303 and 304 (see FIG. 10) of tongue bars 301 and 302, respectively, as a result of the upward spring force provided by springs 212 and 213. Once vertically positioned in the "latch" position, pin 241 will contact tab 260 located on the underside of push button 203. Pin 241 is shoulder mounted and press fitted into pawl 205 to provide centralized moving force when a user depresses push button 203 to "unlatch" the tongue bars from latching pins 239 and 240. The spring force provided by springs 206 and 207, as in the earlier embodiment, enables members 208 and 209 to eject tongue bars 301 and 302 when one tongue bar is individually inserted the pawl 205 is in the unlatched position. Tabs 225 are retained within channels 210 and 211 to prevent push button 203 from rotating about the actuator tab 260, and thereby retaining push button 203 in a proper position coincident with aperture 220. Spring 215 provides a resilient upward force to the underside of push button 203.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A pair of tongues lockingly engageable with a belt buckle comprising:

a first tongue including a first main body with an elongated first member extending therefrom in a first direction and insertable into a buckle and further including an aperture through which a first web is mountable, said first main body including a U-shaped channel; and a second tongue including a second main body with an elongated second member extending therefrom in said first direction and insertable into said buckle and further including a second aperture through which a second web may be mounted, said second main body including a U-shaped surface sized to removably and slidably engage said U-shaped channel of said first tongue thereby positioning said elongated first member adjacent to and in the same plane as said elongated second member so each tongue is independently insertable into said belt buckle.

2. A pair of tongues lockingly engageable with a belt buckle comprising:

a first tongue including a first main body with an elongated first member extending therefrom in a first direction and insertable into a buckle and further including an aperture through which a first web is mountable, said first main body including a U-shaped channel; and a second tongue including a second main body with an elongated second member extending therefrom in said first direction and insertable into said buckle and further including a second aperture through which a second web may be mounted, said second main body including a U-shaped surface sized to removably and slidably engage said U-shaped channel of said first tongue thereby positioning said elongated first member adjacent to and in the same plane as said elongated second member so each tongue is independently insertable into said belt buckle, and wherein said first and second elongated member each include a latching notch for engaging at latch within said buckle.

3. The tongue of claim 2 wherein said latching notches are symmetrically opposed when said first and second tongue are positioned adjacent one another.

4. The tongue of claim 3 wherein said first and second elongated members include raised portions on one side of said members, said raised portions formed to mate with an aperture of said buckle when said tongues are properly inserted into said buckle.

5. The tongue of claim 4 wherein said U-shaped channel and U-shaped surfaces of said tongues are molded plastic formed over a metal reinforcing plate, and wherein said elongated members are extensions of said metal reinforcing plate.

6. A belt buckle-tongue combination comprising:

a buckle main body;

tongue means insertable along a plane extending into said buckle main body with said tongue means releasable lockable with said buckle main body;

a latch positioned in said main body and held captive therein, said latch movable in a linear direction between a latched position with said tongue means and an unlatched position, said latch including a guide pin fixedly attached directly thereto and oriented so that the axis of said pin is aligned wit the direction of linear motion of said latch when said latch moves between said latched and said unlatched position;

first means operably associated with said latch to move said latch back and forth between said latched position and said unlatched position; and bushing means mounted within said main body for defining an axis of movement for said guide pin, said bushing means receiving said guide pin therein to confine movement of said guide pin along a single axis and limit said latch from assuming a position askew to said plane.

7. The combination of claim 6 including false latching means movably mounted in said body and contactable and moved by said tongue means when inserted into said body, said false latching means being operable to allow said latch to lockingly engage said tongue means when said tongue means is in a first condition and inserted into said body and further operable to hold said latch from locking engagement with said tongue means when said tongue means is in a second condition.

8. A belt buckle-tongue combination comprising:

buckle tongue means of elongate shape extending in a plane;

a buckle main body having a cavity therein to slidably receive said tongue means;

a movable latch including a guide pin fixedly attached directly thereto, said latch mounted in said body and movable in a linear direction for engaging said tongue means inserted in the body;

manual operating means accessible at the exterior of the body and engaged with said latch being movable to move said latch in said linear direction and relative to said tongue means;

bushing means within said main body for defining an axis of movement in said linear direction for said guide pin, said bushing means receiving said guide pin to confine movement of said guide pin along a single axis and limit said latch from assuming a position askew to said plane;

first spring means being operable to normally apply force against said movable latch to move same into engagement with said tongue means when inserted into the body in a first condition but yieldable to allow movement of said movable latch away from said tongue means; and, false latching means movably mounted in said body and contactable and moved by said tongue means when inserted into said body, said false latching means being operable to allow said latch to lockingly engage said tongue means when said tongue means is in a first condition and inserted into said body and further operable to hold said latch from locking engagement with said tongue means when said tongue means is in a second condition.

9. A belt buckle tongue combination comprising:

buckle tongue means of elongate shape;

a buckle main body having a cavity therein to slidably receive said tongue means;

a movable latch including a guide pin attached thereto, said latch mounted in said body for engaging said tongue means inserted in the body;

manual operating means accessible at the exterior of the body and engaged with said latch being movable to move said latch relative to said tongue means;

first spring means being operable to normally apply force against said movable latch to move same into engagement with said tongue means when inserted into the body in a first condition but yieldable to allow movement of said movable latch away from said tongue means; and, false latching means movably mounted in said body and contactable and moved by said tongue means when inserted into said body, said false latching means being operable to allow said latch to lockingly engage said tongue means when said tongue means is in a first condition and inserted into said body and further operable to hold said latch from locking engagement with said tongue means when said tongue means is in a second condition and wherein:

said tongue means includes a pair of tongues including a first tongue and a second tongue, said first tongue and said second tongue are movably engageable together when in said first condition but are separated apart when in said second condition:

said false latching means contacts and holds said latch from locking engagement when only one of said tongues is inserted into said main body; and said false latching means includes a first slide, a second slide, and slide spring means with said slide spring means normally urging said first slide and said second slide against said latch but yieldable to allow said first slide to move away from said latch when contacted and moved by said first tongue while said second slide remains against said latch holding same away from locking engagement until contacted and moved by said second tongue away from said latch allowing said latching means to move into locking engagement with said first tongue and said second tongue, said first slide and said second slide include projections movable over and against said latch by said slide spring means and further include concave surfaces contactable by said first and second tongues; said first and second tongues each include a cutout and said latch includes two latching pins each mateably engaging one of said tongue cutouts when said latch lockingly engages said tongues.

10. The combination of claim 9 wherein said main body includes a housing and a cover removably mounted to said housing and further includes a push button slidably mounted to said cover and operably associated with said latch, said cover and said main body form a tongue receiving cavity with said latch projecting into said cavity to lock said tongues inserted therein.

11. The combination of claim 10 wherein said buckle main body includes a reinforcement plate mounted between said housing and said cover, said plate including a guide bushing for slidably receiving said guide pin, and said plate also including tongue guide means formed from said plate to further define said tongue receiving cavity and provide a guide for insertion of said tongues.

* * * * *